United States Patent [19]

Muzyka et al.

[11] 3,935,037

[45] Jan. 27, 1976

[54] AUSTENITIC IRON-NICKEL BASE ALLOY

[75] Inventors: Donald R. Muzyka, Reinholds; Ronald C. Gebeau, West Lawn, both of Pa.

[73] Assignee: Carpenter Technology Corporation, Reading, Pa.

[22] Filed: Apr. 18, 1974

[21] Appl. No.: 462,127

[52] U.S. Cl. ..... 148/38; 75/124; 175/125; 75/128 F; 75/128 G; 75/128 T; 75/128 W; 75/128 V

[51] Int. Cl.[2] ..... C22C 38/44; C22C 38/46; C22C 38/50; C22C 38/54

[58] Field of Search..... 75/124, 125, 128 A, 128 F, 75/128 G, 128 T, 128 W, 128 V; 148/37, 38

[56] References Cited

UNITED STATES PATENTS

| | | | |
|---|---|---|---|
| 3,065,067 | 11/1962 | Oggen | 75/124 |
| 3,212,884 | 10/1965 | Soler et al. | 75/124 |
| 3,243,287 | 3/1966 | Lillys et al. | 75/128 G X |
| 3,300,347 | 1/1967 | Kasza et al. | 75/128 G X |
| 3,362,813 | 1/1968 | Ziolkowski | 75/124 X |
| 3,420,660 | 1/1969 | Kawakata et al. | 75/124 X |
| 3,795,552 | 5/1974 | Kegerise et al. | 75/128 T X |

*Primary Examiner*—L. Dewayne Rutledge
*Assistant Examiner*—Arthur J. Steiner
*Attorney, Agent, or Firm*—Edgar N. Jay

[57] ABSTRACT

An iron-nickel base alloy containing 0.10% Max. carbon, 2% Max. manganese, 1% Max. silicon, 13.5–16% chromium, 24–28% nickel, 1–1.75% molybdenum, 1.6–2.7% titanium, 0.7–1.2% columbium, 0.5% Max. vanadium, 0.35% Max. aluminum, 0.001–0.01% boron, and the balance iron plus incidental impurities having improved strength as compared to A-286 Alloy and capable of attaining at least about 180 ksi yield strength when cold worked as little as about 15% and precipitation hardened. The alloy is especially useful in making large massive parts such as retaining rings which are substantially fully austenitic and nonmagnetic for the rotor windings of very large electric generators.

10 Claims, No Drawings

AUSTENITIC IRON-NICKEL BASE ALLOY

BACKGROUND OF THE INVENTION

This invention relates to an austenitic iron-nickel base alloy and more particularly to such an alloy which can be brought to a high strength level while retaining a unique degree of its toughness.

It has long been sought to increase the strength of large nonmagnetic austenitic parts of thick cross section without substantially increasing the cost of the parts made therefrom which already are expensive. Such large nonmagnetic parts, as for example, retaining rings for the copper windings at the ends of the rotor in large turbine driven electric generators may each weigh several thousand pounds and in addition to being nonmagnetic must also be strong enough to resist the stresses resulting from its own mass and the centrifugal force of the rotating windings.

Heretofore, an alloy containing nominally about 0.5% carbon, 18% manganese, 5% chromium and the balance iron (here designated Alloy A for convenience) has been used to make such large nonmagnetic parts but it has left much to be desired. For one thing, Alloy A cannot be strengthened by heat treatment and consequently has required extensive cold working which is expensive because of the special equipment required to carry out such large amounts of cold work in such large, massive parts. In any event, the upper limit of about 160 ksi 0.2% yield strength (Y.S.) as measured by standard room temperature tensile specimens is not adequate for very large electric generators.

Very large electric generators requiring retaining rings stronger than those which can be provided from Alloy A have been in demand for many years as is evident from the article by K. E. Fritz and D. R. DeForest, "High-Strength Turbo-Generator Retaining Ring Forgings of an Age Hardenable Austenitic Alloy" (Journal of Materials, 1968, pp. 629–645). Fritz and DeForest propose forming such large nonmagnetic parts from A-286 Alloy (A.I.S.I. 660) and show that by combined cold working and aging the 0.2% Y.S. of A-286 Alloy parts can be increased to about 175 ksi. Unfortunately, as Fritz and DeForest point out, the amount of cold working required by parts made from A-286 Alloy to achieve that level of strength is 30 percent. Thus, some improvement in strength can be obtained by using A-286 alloy instead of Alloy A, but the large amount of cold work and the attendant expense remain. The A-286 Alloy as used by Fritz and DeForest had a nominal composition of about 0.05% carbon, 1.25% manganese, 0.5% silicon, 25.5% nickel, 14.75% chromium, 1.3% molybdenum, 0.25% vanadium, 2.3% titanium, 0.25% aluminum, 0.005% boron and the balance iron.

SUMMARY OF THE INVENTION

It is, therefore, a principal object of this invention to provide an improved iron-nickel base alloy which is capable of being strengthened both by heat treatment alone or by a combination of cold work and heat treatment to significantly higher levels than attainable by A-286 Alloy without adding significantly to the cost or difficulty of fabricating parts therefrom.

A more specific object is to provide such an alloy and articles made therefrom strengthened by a combination of less than 20% cold work and precipitation hardening to a 0.2% Y.S. of at least about 180 ksi.

The foregoing as well as additional objects and advantages of the present invention are substantially attained by providing an alloy the composition of which is conveniently summarized in tabular form as consisting essentially in weight percent of about

| | Broad Range | Preferred Range |
|---|---|---|
| Carbon | 0.10* | 0.08* |
| Manganese | 2* | ** |
| Silicon | 1* | ** |
| Chromium | 13.5–16 | 13.5–16 |
| Nickel | 24–28 | 24–28 |
| Molybdenum | 1–1.75 | 1–1.75 |
| Titanium | 1.6–2.7 | 1.9–2.5 |
| Columbium (Niobium) | 0.7–1.2 | 0.8–1.1 |
| Vanadium | 0.5* | 0.1–0.5 |
| Aluminum | 0.35* | 0.1–0.35 |
| Boron | 0.001–0.01 | 0.003–0.01 |

*Maximum

**Manganese and silicon are not essential in this composition for articles to be used at room temperature or the temperatures encountered in electric generators which is usually less than about 500°F. However, when articles made from this composition are to be stressed at elevated temperature then the manganese and silicon are preferably present in the amounts specified in U.S. Patent No. 3,795,552, that is 0.15–2%, preferably 0.15–0.40% manganese and 0.10–0.30%, preferably 0.15–0.25% silicon.

The balance is iron except for incidental impurities which may also include phosphorus up to a maximum of 0.04%, sulfur up to a maximum of 0.03%, copper up to a maximum of 0.5%. It is to be noted that by the foregoing tabulation, it is not intended to restrict the preferred ranges for use solely in combination with each other. Thus, one or more of the preferred ranges can be used with any one or more of the broad ranges. In addition a preferred range limit for an element can be used with a broad range limit for that element.

DESCRIPTION OF THE PREFERRED EMBODIMENT

The composition of the present invention differs from hitherto known A-286 Alloy and modifications thereof primarily by the addition of a sharply critical amount of columbium (niobium). Nevertheless, the composition is substantially fully austenitic and nonmagnetic. To provide the improved strength characteristic of this alloy, a minimum of about 0.7% columbium is required. Below about 0.5% no significant effect, if any at all, can be observed on the 0.2% Y.S. of A-286 Alloy. Too much columbium appears to cause the formation of an undesired Laves phase (which may be generalized as $M_2$[Ti,Cb]). Therefore, no more than about 1.2% columbium is used. Preferably, 0.8 to 1.1% is used. Within the ranges stated, the larger amounts of columbium are used with the lower amounts of titanium to minimize the likelihood of Laves phase being formed.

The mechanism by which the improved strength characteristic of this alloy is achieved is not fully understood but it is believed that the critical addition of columbium works to strengthen the alloy. The columbium may also work to make the amount of titanium present as effective as a substantially larger amount of titanium but without the drawbacks usually resulting from increasing titanium as is, for example, characteristic of V-57 Alloy (A.I.S.I. 663). Titanium works as a precipitation strengthener in the form of a nickel-titanium precipitate identified as $Ni_3Ti$, or as $Ni_3(Ti,Al)$ when aluminum is present, and at least about 1.6% titanium is required for this purpose. Some of the columbium present may also be precipitated as $Ni_3$(-

Ti,Cb), or $Ni_3$(Ti,Al,Cb) when aluminum is present. The columbium may also function to free some of the titanium for precipitation which otherwise would be tied up so as not to take part in the precipitation reaction. Up to about 2.7% titanium can be used without an objectionable loss in ductility. Preferably about 1.9 to 2.5% and better yet, no more than about 2.3% is used for best results. However, to maximize yield strength the largest amounts of titanium, that is up to about 2.7% can be used.

Nickel is a strong austenite-forming element and in addition takes part with titanium in the main strengthening reaction to form the precipitate $Ni_3Ti$ and $Ni_3$(Ti,Al) as well as the $Ni_3$(Ti,Cb) and $Ni_3$(Ti,Al,Cb) that may be formed. Therefore, at least about 24% nickel is required. Above about 28%, the benefit gained does not appear to be warranted by the additional cost of the alloy.

Chromium works predominantly to provide oxidation resistance and corrosion resistance. Chromium also works as a solid solution strengthener. Thus, about 13.5–16% chromium is used in the composition. Molybdenum also functions as a solid solution strengthener and preferably about 1 to 1.75% is included for that purpose.

A small amount of vanadium, up to about 0.5%, preferably about 0.1 to 0.5%, can be included for its beneficial effect upon the ductility of the composition. When present, aluminum contributes to the stability of the gamma prime precipitate, $Ni_3Ti$ or $Ni_3$(Ti,Cb), and up to 0.35% is used for that purpose. Preferably a minimum of about 0.1% aluminum is present and for best results a minimum of about 0.15% aluminum is used.

Though only present in a small amount, boron is an essential element for its particular effect upon the forgetability of the composition. For this effect, at least about 0.001% is present and preferably 0.003 to 0.01% is used.

The alloy is readily prepared and worked using conventional manufacturing techniques, and those hitherto used in making and working A-286 Alloy can also be used in preparing the present composition and making articles therefrom. Depending upon the end use and the properties desired the alloy can be melted in air using a single melting practice or multiple melting practices can be employed in which an ingot previously cast is remelted as a consumable electrode. It is desirable that processing be carried out to provide a substantially uniform structure essentially free from segregation of the hardening elements titanium and columbium to avoid the presence of Laves phase in the final product. To this end, it may be desirable to homogenize forgings by holding them just below the melting temperature long enough for homogenization by diffusion to occur. Solution treatment can be carried out between about 1600° and 1900°F, preferably at about 1650°F or 1800°F depending upon whether maximum strength or maximum rupture life is desired. Aging can also be varied as desired between about 1175° to 1350°F to favor hardness and strength depending upon the degree of cold working before aging. The lower temperatures, about 1175° to 1225°F provide best results for about 15 to 20% cold working while about 1300°F to 1350° is best for articles not cold worked before aging. One specific heat treatment that can be used is to solution treat at 1800°F for 1 hour followed by quenching in oil and then heating at 1325°F for 16 hours followed by cooling in air. The material can also be heated at 1650°F for 2 hours followed by quenching in oil and then aging at 1325°F for 16 hours followed by cooling in air. For maximum strength, it is preferred to solution treat at 1650°F for 2 hours, oil quench, then age at about 1200° to 1325°F for 8 hours depending on the degree of cold working, cool at the rate of 100°/hr. to 1050°–1150°F, hold for 8 hours, and then air cool.

EXAMPLE 1

An experimental 17 pound vacuum induction heat was prepared having the following composition as cast:

| | Weight Percent |
|---|---|
| Carbon | 0.04 |
| Manganese | 1.4 |
| Silicon | 0.4 |
| Chromium | 13.9 |
| Nickel | 24.7 |
| Molybdenum | 1.3 |
| Titanium | 2.1 |
| Vanadium | 0.3 |
| Aluminum | 0.15 |
| Columbium | 1.01 |
| Boron | 0.004 |

and the balance was iron and incidental impurities which included less than 0.005% phosphorus and less than 0.005% sulfur.

The ingot was homogenized at 2100°F for 24 hours and then forged from a temperature of 2050°F to a 1 in. sq. bar. Sections of the bar 4 ins. long were then flattened to ⅝ in. thick from 1850°F. Room temperature tensile specimens having a 0.252 in. diameter and 1 in. long gage portion were formed from the ⅝ in. forgings, solutioned at 1650°F for 2 hours, oil quenched, and, after different degrees of cold working equal to 0, 0.08 and 0.16 true strain (corresponding respectively to 0%, 8%, and 15% cold work), were aged at 1325°F for 8 hours, furnace cooled at a rate of 100°F/hour to 1150°F, held for 8 hours and then air cooled. The hardness of the heat treated specimens was about Rockwell A 68 or about Rockwell C 35. The amounts of cold work specified were applied to the test specimens by straining in a tensile machine at 0.01 in./min. which is considered to be a good simulation of the cold expansion process used in the manufacture of large retaining ring forgings. The true strain is calculated as the natural logarithm (ln) of the ratio of the starting cross section area ($A_o$) to the cross section area (A) after cold working that is ($\ln A_o/A$).

The results of the room temperature tensile tests for the specimens subjected to 0, 0.08 and 0.16 true strain are set forth in Table I where the ultimate tensile strength in thousands of pounds per square inch is given under UTS (ksi), the 0.2% yield strength is given under 0.2% Y.S., the percent elongation is given under Elong. (%), and the percent reduction in area is given under R.A. (%).

TABLE I

| True Strain | UTS (ksi) | .2%Y.S. (ksi) | Elong (%) | R.A. (%) |
|---|---|---|---|---|
| 0 | 182 | 141 | 15.8 | 22.3 |
| | 181 | 141 | 18.1 | 34.6 |
| 0.08 | 191 | 168 | 12.1 | 22.6 |
| | 190 | 166 | 14.0 | 33.6 |
| 0.16 | 203 | 186 | 10.2 | 30.1 |
| | 198 | 181 | 12.0 | 29.9 |

The alloy of this invention is especially well suited for use in making austenitic, nonmagnetic articles such as retaining rings for very large turbine driven electric generators. Such rings when finished may be in the form of a hollow cylinder about 3.5 feet in diameter, 2.5 feet long and a wall thickness of 3 ins. Such a ring weighs about 4,000 pounds.

The 0.16 true strain imparted to the test specimens represented the limit of uniform plastic deformation, that is, just below the start of necking. Additional cold work beyond the 15% or 0.16 true strain can be imparted to the workpiece before aging to obtain somewhat greater strength. The foregoing data clearly demonstrates the significant improvement attained in sharply reducing the amount of cold work required to attain 180 ksi 0.2% Y.S. As compared to the 30% cold work and only 175 ksi 0.2% Y.S. obtained by Fritz and DeForest (Op. Cit. p. 633).

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An iron-nickel base cold worked and precipitationed strengthened article subjected to less than 20% cold work before being precipitation strengthened to 0.2% yield strength of at least 180 ksi, the composition of said article consisting essentially in weight percent of about

| | |
|---|---|
| Carbon | 0.10 Max. |
| Manganese | 2 Max. |
| Silicon | 1 Max. |
| Phosphorus | 0.04 Max. |
| Sulfur | 0.03 Max. |
| Chromium | 13.5–16 |
| Nickel | 24–28 |
| Molybdenum | 1–1.75 |
| Titanium | 1.6–2.7 |
| Columbium | 0.7–1.2 |
| Vanadium | 0.5 Max. |
| Aluminum | 0.35 Max. |
| Boron | 0.001–0.01 |
| Copper | 0.5 Max |

2. The article as set forth in claim 1 containing about 1.9%–2.5% titanium, 0.8%–1.1% columbium, and at least 0.1% aluminum.

3. The article as set forth in claim 2 containing at least about 0.15% aluminum.

4. The article as set forth in claim 3 containing no more than about 2.3% titanium.

5. The article as set forth in claim 1 which contains a maximum of about 0.08% carbon and about 1.9% to 2.5% titanium.

6. The article as set forth in claim 5 which contains at least about 0.1% aluminum.

7. The article as set forth in claim 6 which contains about 0.8% to 1.1% columbium.

8. The article as set forth in claim 7 which contains no more than about 2.3% titanium.

9. The article as set forth in claim 7 which contains at least 0.015% aluminum.

10. The article as set forth in claim 1 which contains about 0.04% carbon, 1.4% manganese, 0.4% silicon, 13.9% chromium, 27.7% nickel, 1.3% molybdenum, 2.1% titanium, 0.3% vanadium, 0.15% aluminum, 1% columbium, 0.004% boron.

* * * * *

UNITED STATES PATENT OFFICE

CERTIFICATE OF CORRECTION

PATENT NO. : 3,935,037

DATED : January 27, 1976

INVENTOR(S) : Donald R. Muzyka and Ronald C. Gebeau

It is certified that error appears in the above-identified patent and that said Letters Patent are hereby corrected as shown below:

Item [52], U.S. Cl., for "175/125" read -- 75/125 --.

Item [56], References Cited, for "Oggen" read -- Aggen --; and for "Kawakata" read -- Kawahata --.

Col. 3, line 36, for "forgetability" read -- forgeability --.

line 63, after "1350°" insert -- F --.

Col. 6, line 11, in claim 1, after composition table, insert -- and the balance essentially iron and incidental impurities. -- line 28, for "claim 7" read -- claim 8 --; and line 29, for "0.015%" read -- 0.15% --.

Signed and Sealed this fifteenth Day of June 1976

[SEAL]

Attest:

RUTH C. MASON
*Attesting Officer*

C. MARSHALL DANN
*Commissioner of Patents and Trademarks*